US005634667A

United States Patent [19]

Jordan

[11] Patent Number: 5,634,667

[45] Date of Patent: Jun. 3, 1997

[54] ALBUM FOR HOLDING MEMORABILIA

[76] Inventor: Aurellius M. Jordan, 620 Iris Ave. #128, Sunnyvale, Calif. 94086

[21] Appl. No.: 618,531

[22] Filed: Mar. 19, 1996

[51] Int. Cl.[6] ..... B42D 3/00

[52] U.S. Cl. ..... 281/29; 281/31; 281/37

[58] Field of Search ..... 281/29, 31, 36, 281/37; 402/70, 73

[56] References Cited

U.S. PATENT DOCUMENTS

| | | | |
|---|---|---|---|
| 3,798,806 | 3/1974 | Sanford | 40/28.1 |
| 4,484,768 | 11/1984 | Norfleet | 283/1 B |
| 4,991,767 | 2/1991 | Wyant | 281/29 X |
| 5,063,698 | 11/1991 | Johnson et al. | 40/124.1 |
| 5,213,371 | 5/1993 | Bradley | 283/56 |
| 5,219,437 | 6/1993 | Moor et al. | 281/29 |
| 5,275,285 | 1/1994 | Clegg | 206/449 |
| 5,277,452 | 1/1994 | Skidmore | 281/29 X |
| 5,360,234 | 11/1994 | Miller et al. | 281/29 X |

*Primary Examiner*—Willmon Fridie, Jr.

*Attorney, Agent, or Firm*—Patent & Trademark Services; Joseph H. McGlynn

[57] ABSTRACT

A book like album having a front cover with a hologram, photograph, painting or drawing placed thereon which will have a special meaning to the person who owns it. When opened one side of the inside of the album has a specific portion for poetry, memoir cards, a fragrance pouch, a pocket for the memoir cards and a section to display the union of fingerprints superimposed one over another in a specific shape made possible by stencil superimposition. The other portion of the inside has a section for holding art works, a picture, painting or a hologram. Also included inside the album are "Forever Treasure" removable cards about the size of credit cards, personalized with poetry. The album also has a pocket to secure these cards.

2 Claims, 1 Drawing Sheet

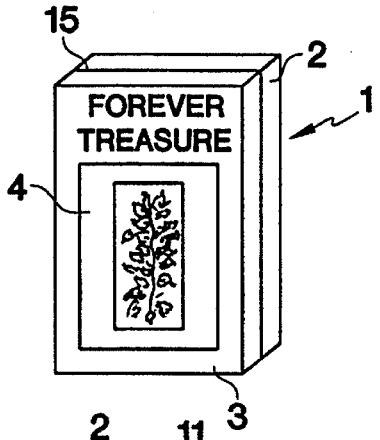
FIG. 1
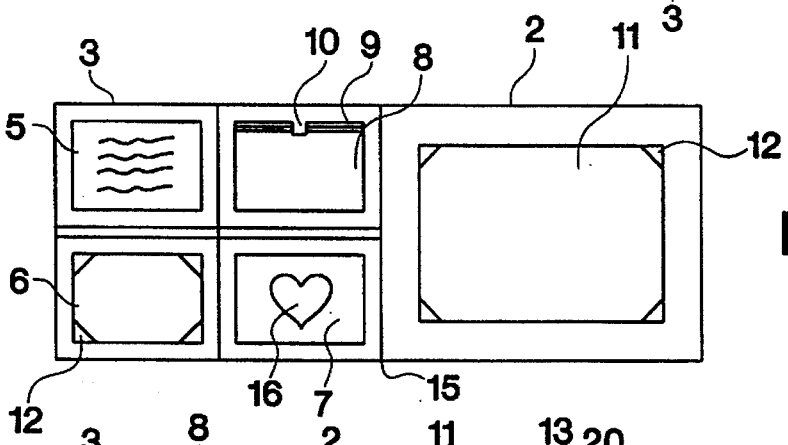
FIG. 2
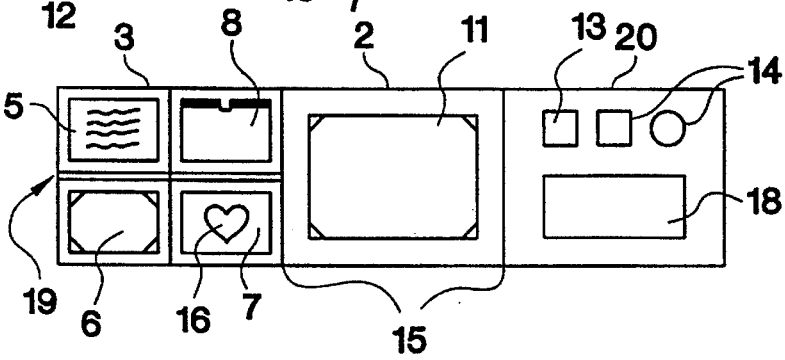
FIG. 3
FIG. 4
DATE: TIME: PLACE:
SPECIAL EVENTS:
GUEST/FRIENDS:
GIFTS:
ATTIRE WORN:
SENTUAL APPEALS:
(SOUND, SMELL, TASTES)
FOODS:
17
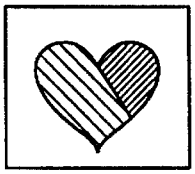
FIG. 5A
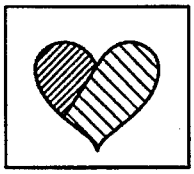
FIG. 5B
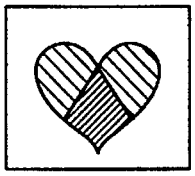
FIG. 5C

ALBUM FOR HOLDING MEMORABILIA

BACKGROUND OF THE INVENTION

This invention relates, in general, to albums, and, in particular, to albums for retaining memories of events and occurrences that remind a person of events, persons, or places that have significant meaning.

DESCRIPTION OF THE PRIOR ART

In the prior art various types of keepsake albums have been proposed. For example, U.S. Pat. No. 3,798,806 discloses a musical greeting card which plays a song when the card is opened. U.S. Pat. No. 4,484,768 discloses a greeting card that produces an odor when opened. U.S. Pat. No. 5,063,698 discloses a greeting card with an electronic memory device that stores audible sounds that will be played back when the card is opened. U.S. Pat. No. 5,213,371 discloses a greeting card with a cookie cutter on the front and a cookie mix inside. U.S. Pat. No. 5,275,285 discloses a business card holder which emits sounds when the holder is opened.

While all of the prior art devices are designed to hold a device which will evoke a memory for the person receiving the device, none of the prior art devices are designed to hold different types of devices that a person can add to over a period of time to remind them of prior events, places or people in their lives.

SUMMARY OF THE INVENTION

The present invention consists of a book like album having a front cover with a hologram, photograph, painting or drawing placed thereon which will have a special meaning to the person who owns it. When opened, one side of the inside of the album has a specific portion for poetry, a fragrance pouch, a pocket for memoir cards and a section to display a removable card. The other portion of the inside has a section for holding art works, a picture, painting or a hologram. Also include inside the album is a sound chip which can store a voice message, sounds or music.

It is an object of the present invention to provide a device for storing articles that evoke memories for the owner.

It is an object of the present invention to provide a device for storing articles that can be added over a period of time.

These and other objects and advantages of the present invention will be fully apparent from the following description, when taken in connection with the annexed drawings.

BRIEF DESCRIPTION OF THE DRAWINGS

FIG. 1 is a perspective view of the outside cover of the present invention.

FIG. 2 is a plan view of the inside of the present invention.

FIG. 3 is a plan view of another embodiment of the present invention.

FIG. 4 is a view of an actual memoir card.

FIGS. 5A–5C are views of stencils that could be used.

DESCRIPTION OF THE PREFERRED EMBODIMENT

Referring now to the drawings in greater detail, FIG. 1 shows the outside of the album of the present invention 1, which consists of a two page album 2 and 3 which are hinged at 15. The outside cover 3 has an area 4 to which a hologram, photograph, painting, or drawing that has special significance to a person can be attached. The various articles can be attached by any conventional attaching means such as, but not limited to, glue or Velcro hook and loop fasteners.

The embodiment shown in FIG. 2 opens to show two pages inside. The first page 3 is divided into four portions 5, 6, 7, 8, however more portions may be added if desired. Portion 5 is a portion designated for an engraved or uniquely bordered poem, inseparable from the invention. Portion 6 has holders 12 mounted at the corners, such as by, but not limited to, glue. The holders are for holding and commemorating special events. The holder will initially hold the prototype card 17, shown in FIG. 4. Pocket 19 can hold cards that are old and have some special significance to the owner of the album.

The holders 12 can hold a card by slipping the corners of the card beneath each of the holders. The cards could be of various sizes depending on how far apart the holders 12 are mounted. The cards 17 are memoir cards and are a primary entity of the invention. They are used for the purpose of recording special events, similar to diary entries.

The portion 7 holds the stencil(s) 16 and is to be removed after finger prints are superimposed one over another on a blank card (not shown) which will be attached at 7. The stencil 16 is illustrated as a heart, however the stencil could take a variety of shapes. Also, more than one stencil could be supplied and they could be superimposed to produce a variety of effects to decorate the album.

Portion 8 holds a bag such as, but not limited to, a zip-lock bag which has an open portion 10 and a portion 9 which can be opened to place an object such as an article with a pleasant aroma. Once the object is in the bag the zip-lock can be closed to retain the object while the slot 10 will allow the fragrance to escape.

The other page 2 could have holders 12 mounted at the corners to secure a photograph, drawing, hologram or painting. It also could be divided into portions such as page 3.

In FIG. 3 another embodiment of the album is shown which has the same two pages as the embodiment in FIG. 2, and a third page 20 has been added. Page 20 has a photo compartments 14, a section for storing written messages 18, and a pocket 13 for securing "Forever Treasure cards 17. Also, page 12 has a hinged area 15 similar to the hinge between pages 2 and 3.

Although the forever treasure storage container and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An album for holding memorabilia comprising:

at least two pages which are hinged together so the pages can be opened or closed, said pages having an inside and an outside surface, a first one of said pages having a picture on an outside surface of said page, said first page having at least four portions adjacent each other on an inside surface of said page, one of said portions is a pocket, a second of said portions having a surface that can be written on, a third of said portions having holding means mounted adjacent the boundaries thereof for holding cards, a fourth of said portions having means for holding stencils for superimposing finger prints, one of said portions having means for mounting a bag thereon, said bag having sides, a bottom and a partially open top with means for detachably holding a portion of said partially open top in a closed position, a second of said pages having holding means mounted thereon for holding cards.

2. The album for holding memorabilia as claimed in claim 1, wherein said album has a third page, said third page having a pocket attached thereto, said third page also having means for attaching photographs thereto, said third page having a section for displaying ink messages.

* * * * *